US010426690B2

(12) United States Patent
Tsai

(10) Patent No.: US 10,426,690 B2
(45) Date of Patent: Oct. 1, 2019

(54) FOLDABLE WALKER

(71) Applicant: Care & Care Health Products Co., Ltd., Yuan Li Town (TW)

(72) Inventor: Max Tsai, Yuan Li Town (TW)

(73) Assignee: Care & Care Health Products Co., Ltd., Yuan Li Town (TW)

( * ) Notice: Subject to any disclaimer, the term of this patent is extended or adjusted under 35 U.S.C. 154(b) by 0 days.

(21) Appl. No.: 16/151,530

(22) Filed: Oct. 4, 2018

(65) Prior Publication Data

US 2019/0248399 A1 Aug. 15, 2019

(30) Foreign Application Priority Data

Feb. 9, 2018 (TW) ..... 107104687 A

(51) Int. Cl.
*A61H 3/04* (2006.01)

(52) U.S. Cl.
CPC ..... *A61H 3/04* (2013.01); *A61H 2201/0161* (2013.01); *A61H 2201/1635* (2013.01)

(58) Field of Classification Search
CPC .... A61H 3/04; A61H 2201/0161; A61H 3/00; B62B 7/08
See application file for complete search history.

(56) References Cited

U.S. PATENT DOCUMENTS 3,658,079 A * 4/1972 Block ..... A61H 3/00 135/67
3,688,789 A * 9/1972 Bunch ..... A61H 3/00 135/67
5,201,333 A * 4/1993 Shalmon ..... A61H 3/00 135/67
5,529,425 A * 6/1996 Spies ..... A61H 3/00 135/74
6,886,575 B2 5/2005 Diamond
7,497,226 B2 * 3/2009 Li ..... A61H 3/00 135/67
7,651,649 B2 * 1/2010 Obitts ..... A61H 3/00 264/242
9,700,479 B2 * 7/2017 Tsai ..... A61H 3/04

FOREIGN PATENT DOCUMENTS

CN 2796692 Y 7/2006
CN 200961603 Y 10/2007
TW M511319 U 11/2015

OTHER PUBLICATIONS

Search Report appended to an Office Action issued to Taiwanese counterpart application No. 107104687 by the TIPO dated Dec. 26, 2018, with an English translation thereof.

* cited by examiner

*Primary Examiner* — Noah Chandler Hawk
(74) *Attorney, Agent, or Firm* — Burris Law, PLLC

(57) ABSTRACT

A foldable walker includes a front frame having sleeve tubes, two side frame units and two folding operating units. Each sleeve tube has an upwardly facing retaining portion around the upper periphery thereof. Each side frame unit has a front rod segment and an adaptor coaxially and rotatably mounted to the respective sleeve tube. Each folding operating unit is disposed within the adaptor and has a locking pin extending transversely and movably disposed to be engaged with or disengaged from the upwardly facing retaining portion, and a lock releasing member movably mounted on the adaptor at an upper opening and operable manually to move the locking pin to unlock the side frame unit relative to the front frame.

14 Claims, 8 Drawing Sheets

FOLDABLE WALKER

CROSS-REFERENCE TO RELATED APPLICATION

This application claims priority of Taiwanese Patent Application No. 107104687, filed on Feb. 9, 2018.

FIELD

The disclosure relates to an ambulatory device, and more particularly to a foldable walker.

BACKGROUND

Referring to FIGS. 1 and 2, a conventional walker 1 as disclosed in Chinese Patent No. 2796692Y includes a front frame 11 having two sleeve tubes 111, two side frames 12 each having a front leg 122 rotatably inserted in a respective one of the sleeve tubes 111, and two locking units 13. Each side frame 12 has a horizontal support arm 121 extending horizontally and rearwardly from the front leg 122 for mounting a hand grip thereon.

Each locking unit 13 has amounting seat 15 sleeved and secured on the front leg 122 by means of a fastener 101, an upright locking pin 16 movably disposed in a pin hole 152 of the mounting seat 15, a biasing spring 17 sleeved around the locking pin 16 to bias the locking pin 16 upwardly, and an actuating lever 18 pivotably connected to the front leg 122 at a middle portion 182, and having an actuating and manually operated portions 181, 183 at the front and rear sides of the middle portion 182, respectively. An upward pulling action on the manually operated portion 183 results in downward movement of the actuating portion 181, pressing the locking pin 16 out of a lock opening 143 of an arcuate slot 141 so as to permit movement of the locking pin 16 along the arcuate slot 141. Therefore, the respective side frame 12 can be turned relative to the front frame 11 in folded and unfolded positions.

However, the manually operated portion 183 is disposed under and proximate to the hand grip for facilitating operation, which takes up the gripping space for the user and interferes with the walking of the user using the foldable walker.

Referring to FIG. 3, another conventional foldable walker as disclosed in U.S. Pat. No. 6,886,575 has the locking unit 13 further having a connecting rod 19 which is connected between the actuating lever 18 and the locking pin 16. An upward pulling action on the actuating lever 18 causes the connecting rod 19 to be pulled in an upward direction so as to raise and withdraw the locking pin 16 from the lock opening 143. The presence of the actuating lever 18 that takes up the gripping space causes inconvenience during use of the foldable walker.

SUMMARY

Therefore, an object of the disclosure is to provide a foldable walker that can alleviate at least one of the drawbacks of the prior art.

According to the disclosure, the foldable walker includes a front frame, two side frame units and two folding operating units. The front frame includes two sleeve tubes which are disposed opposite to each other in a left-and-right direction, and each of which extends along an axis in an upright direction. Each of the sleeve tubes has an upwardly facing retaining portion which surrounds the axis and which has an unfolding recessed region and a folding recessed region that are angularly displaced from each other about the axis. Each of the side frame units includes a front rod segment which is coaxially and rotatably mounted to a respective one of the sleeve tubes, a rear rod segment which is opposite to the front rod segment so as to be turnable about the axis relative to the front frame between a folded position, where the rear rod segment is close to the front frame, and an unfolded position, where the rear rod segment is remote from the front frame to be disposed opposite to the front rod segment in a front-and-rear direction, and an adaptor. The adaptor has an upright tubular wall which is coaxially connected to the front rod segment and defines therein an accommodating space that has an upper opening. Each of the folding operating units is disposed in the accommodating space, and includes a locking pin, a connecting member and a lock releasing member. The locking pin has a retained end which is disposed upwardly of the upwardly facing retaining portion, and extends radially and inwardly from the retained end toward the axis. The locking pin is movable along the axis between a locking position, where the retained end is engaged with a selected one of the unfolding and folding recessed regions to hold the respective side frame unit in a corresponding one of the unfolding position and the folding position, and an unlocking position, where the retained end is disengaged from the upwardly facing retaining portion to permit turning of the respective side frame unit relative to the front frame. The connecting member has a lower end which is securely connected to the locking pin, and extends in the upright direction from the lower end to terminate at an upper end which is disposed proximate to the upper opening. The lock releasing member is movably mounted on the adaptor, and has an operating portion which projects from the upper opening to be manually operable, and a driving portion which is connected with the upper end of the connecting member for moving the locking pin from the locking position to the unlocking position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
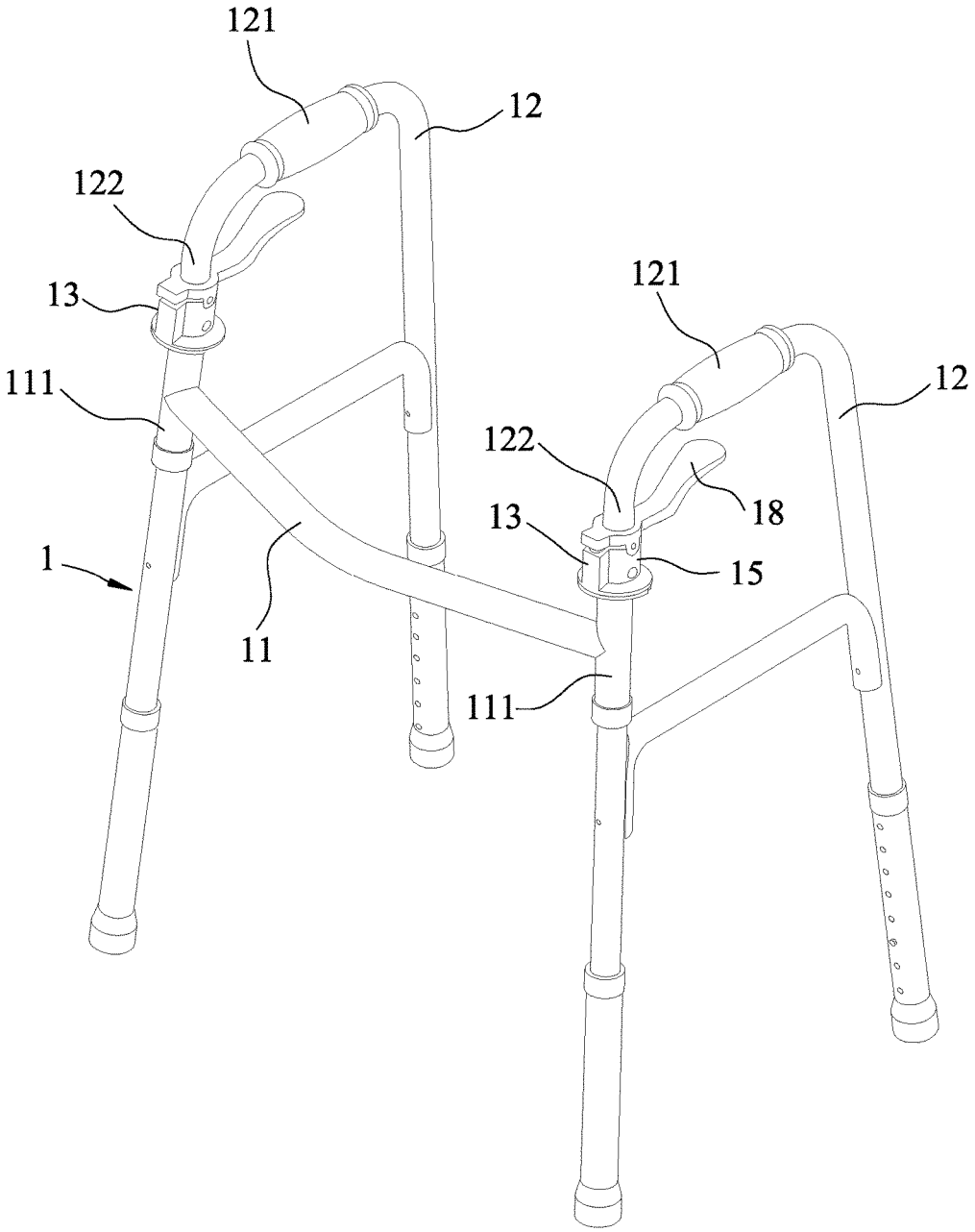
FIG.1 PRIOR ART
FIG. 1 is a perspective view of a conventional foldable walker.
Figure 2:
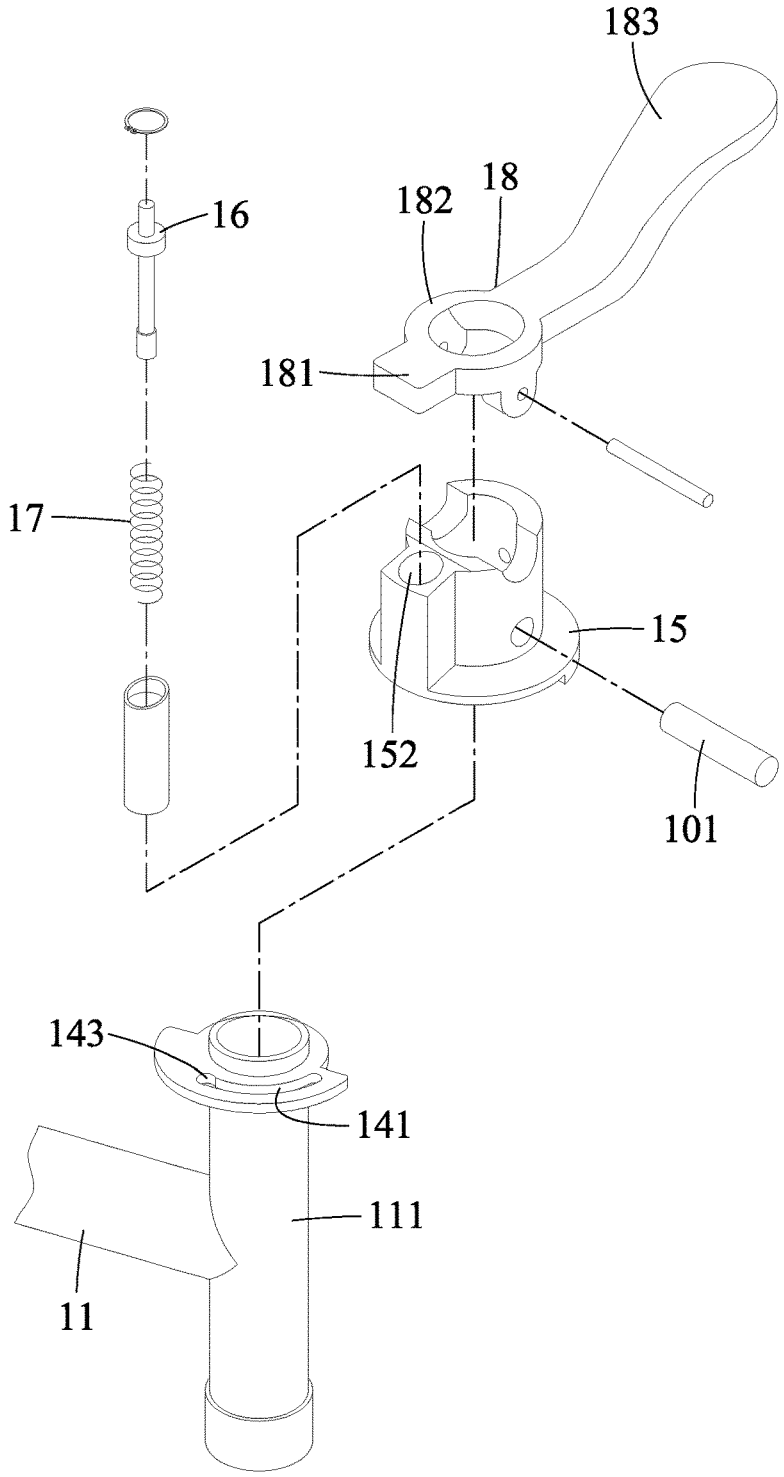
FIG.2 PRIOR ART
FIG. 2 is a fragmentary, exploded perspective view of a locking unit of the conventional foldable walker.
Figure 3:
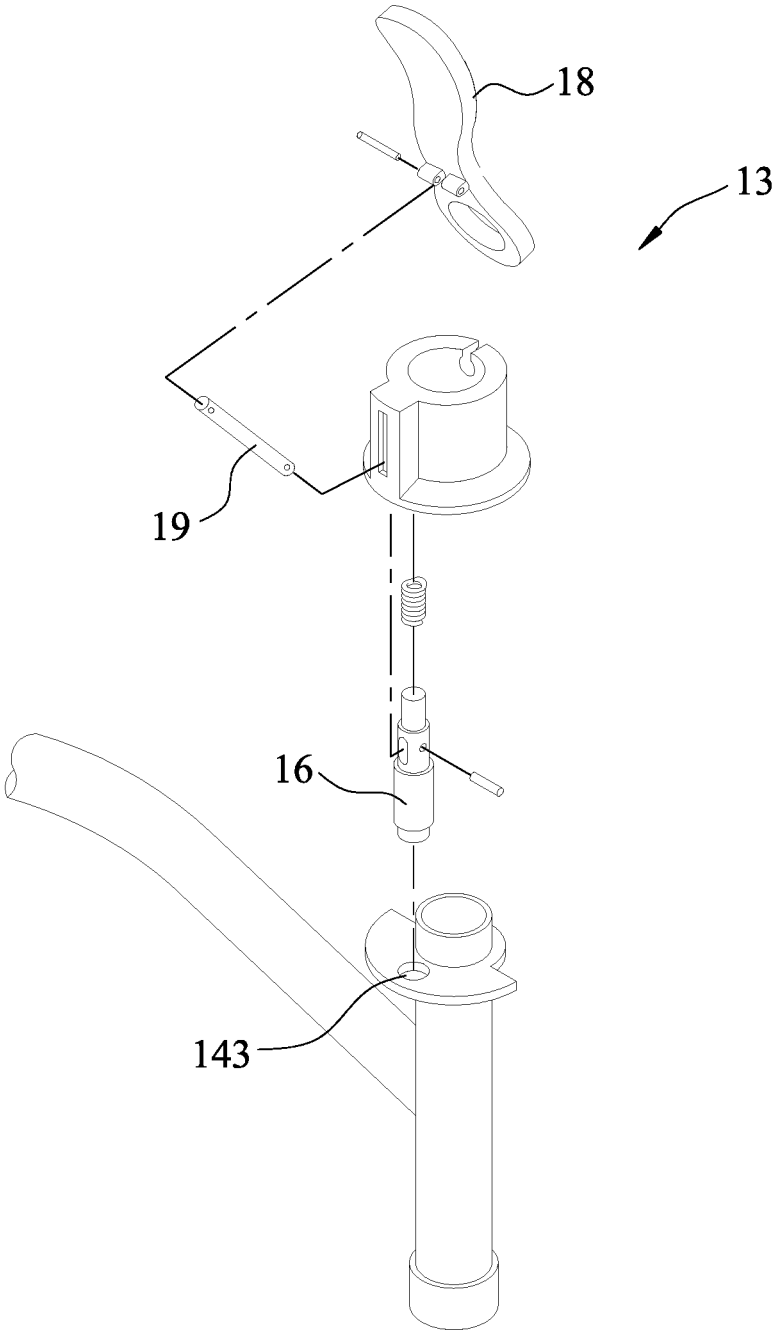
FIG.3 PRIOR ART
FIG. 3 is a fragmentary, exploded perspective view of a locking unit of another conventional foldable walker.
Figure 4:
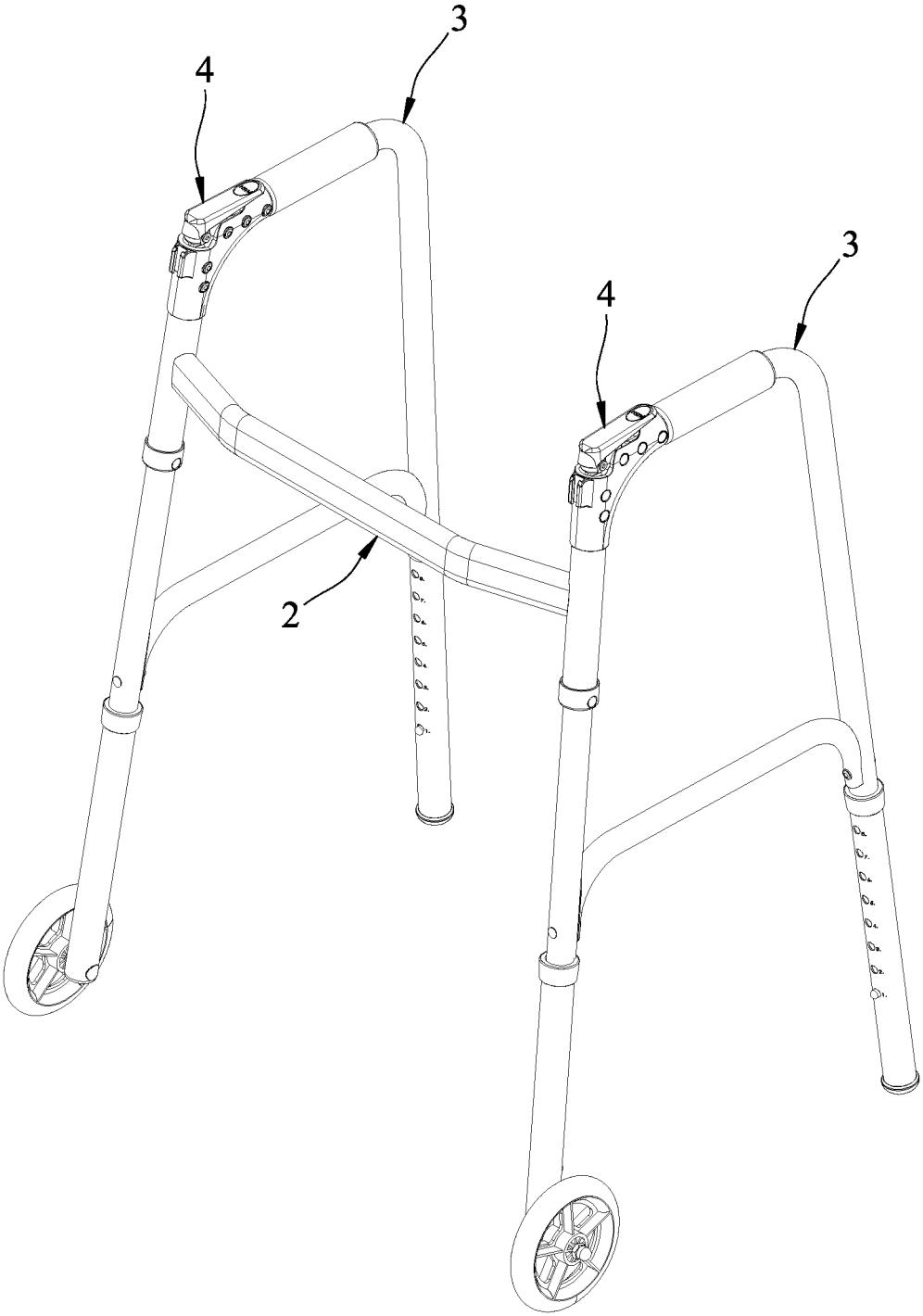
FIG. 4 is a perspective view illustrating an embodiment of a foldable walker according to the disclosure.
Figure 5:
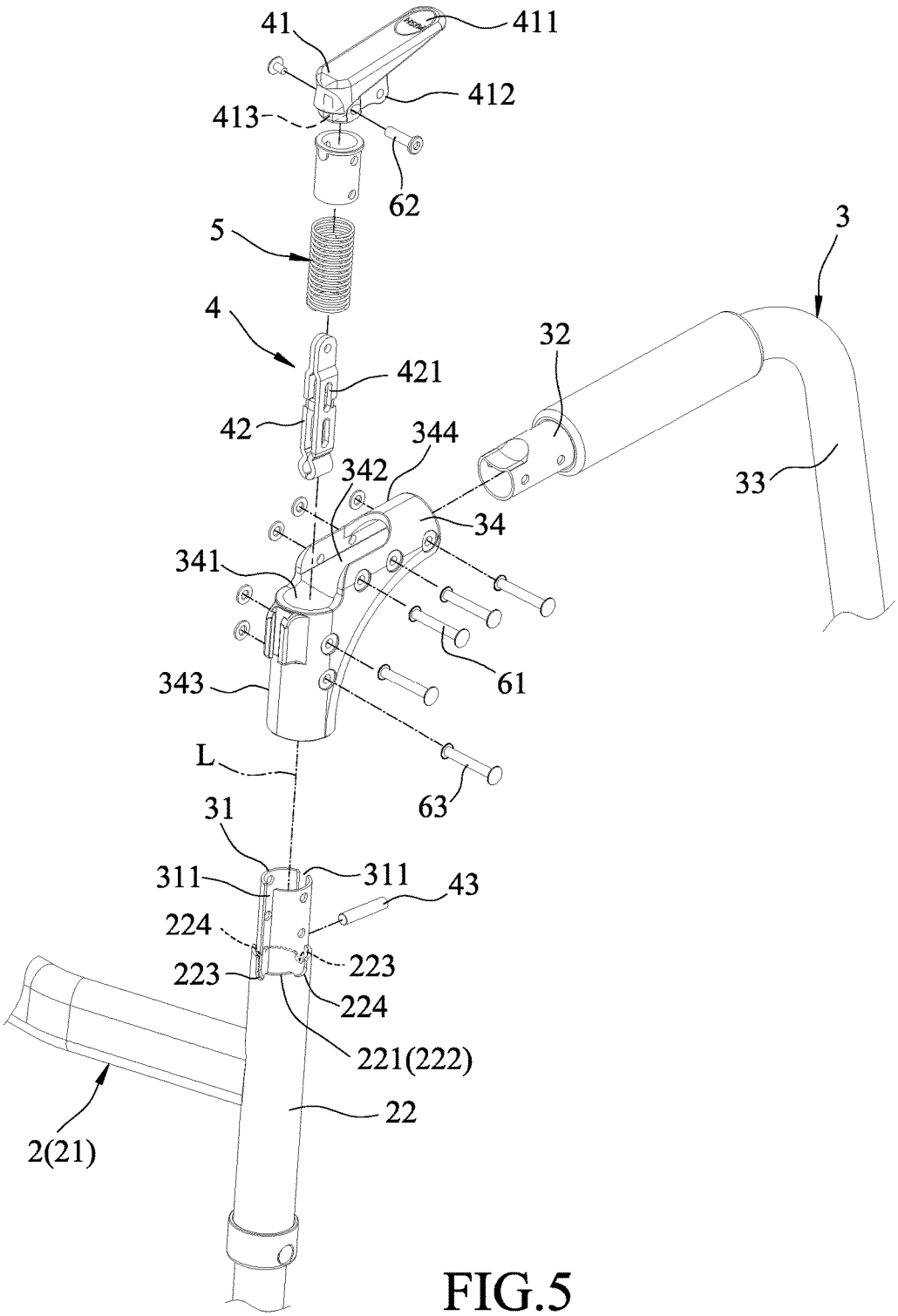
FIG. 5 is a fragmentary, exploded perspective view illustrating a locking unit of the embodiment.
Figure 6:
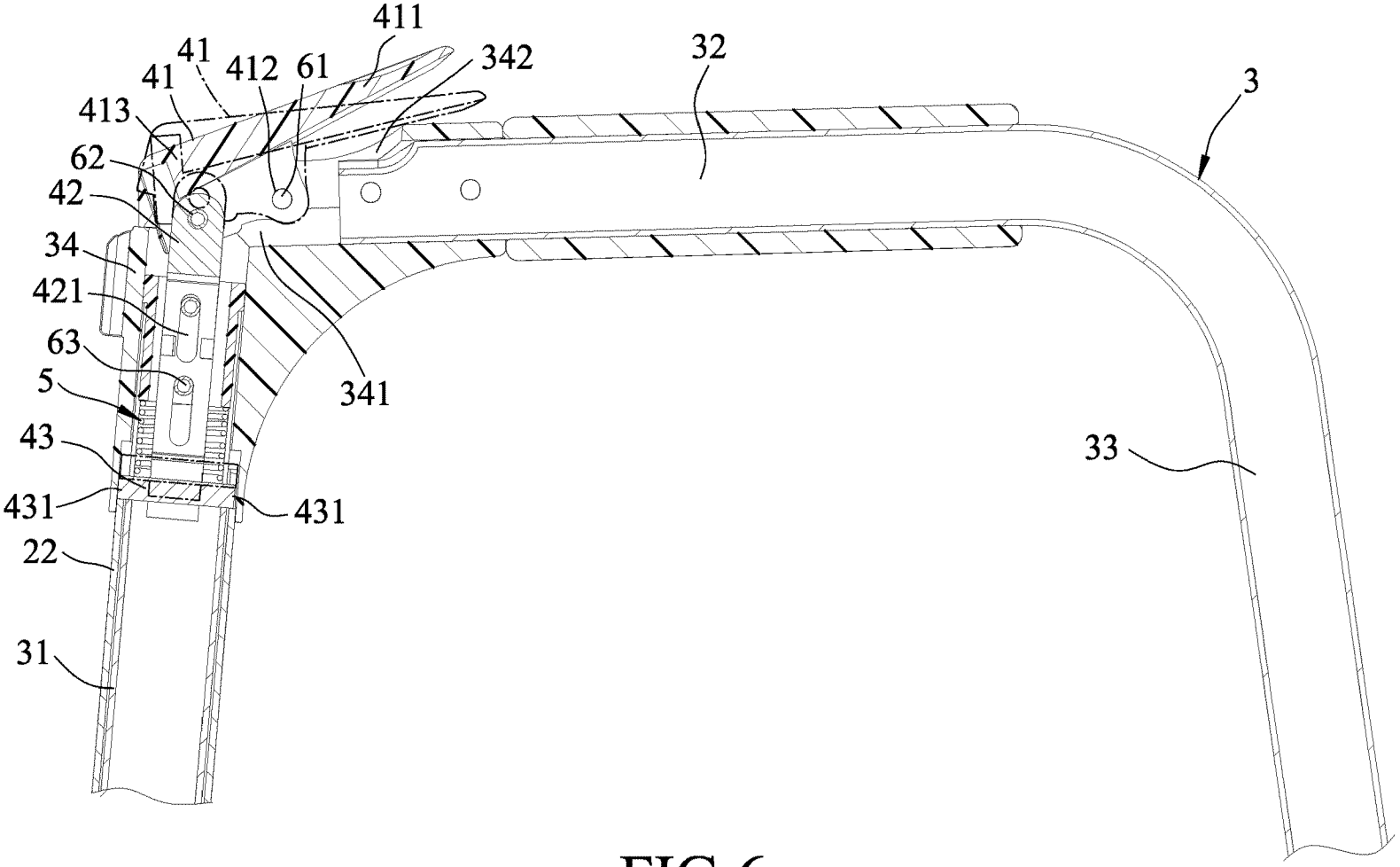
FIG. 6 is a fragmentary sectional view illustrating the locking unit of the embodiment.

Referring to FIGS. 4 to 6, an embodiment of a foldable walker according to the disclosure includes a front frame 2, two side frame units 3 and two folding operating units 4.

The front frame 2 includes two sleeve tubes 22 which are disposed opposite to each other in a left-and-right direction, and each of which extends along an axis (L) in an upright direction, and a transverse brace 21 which extends in the left-and-right direction to interconnect the sleeve tubes 22. Each of the sleeve tubes 22 has an upwardly facing retaining portion 222 which surrounds the axis (L), and which has two diametrically opposite unfolding recessed regions 223 and two diametrically opposite folding recessed regions 224 that are angularly displaced from each other about the axis (L). In this embodiment, each sleeve tube 22 extends upwardly to terminate at an upper end rim 221 which serves as the upwardly facing retaining portion 222.

Each of the side frame units 3 includes a front rod segment 31, a rear rod segment 33, a side horizontal arm 32 and an adaptor 34. The front rod segment 31 is coaxially and rotatably inserted into the respective sleeve tube 22, and has two diametrically opposite splits 311 each extending radially therethrough and elongated in the upright direction. The side horizontal arm 32 has an end connected to an upper end of the rear rod segment 33, and an opposite end disposed proximate to an upper end of the front rod segment 31. The adaptor 34 has an upright tubular wall 343 which is coaxially connected to the front rod segment 31, and a horizontal tubular wall 344 which extends rearwardly from the upright tubular wall 343 to be connected with the side horizontal arm 32. The upright tubular wall 343 defines therein an accommodating space 341 that has an upper opening 342. The upper opening 342 extends rearwardly through the horizontal tubular wall 344.

In this embodiment, each of the side frame units 3 includes a frame body made of two tubes which are machined and connected to the adaptor 34. One of the tubes is formed with two splits 311 at an upper end thereof to serve as the front rod segment 31, and the other one of the tubes is bent to serve as the side horizontal arm 32 and the rear rod segment 33. Thus, the side frame unit 3 is turnable about the axis (L) relative to the front frame 2 between a folded position, where the rear rod segment 33 is close to the front frame 2, and an unfolded position, where the rear rod segment 33 is remote from the front frame 2 to be disposed opposite to the front rod segment 31 in a front-and-rear direction.

Each of the folding operating units 4 is disposed in the accommodating space 341 of the adaptor 34, and includes a locking pin 43, a connecting member 42, a lock releasing member 41 and a biasing member 5. The locking pin 43 extends radially through the splits 311 of the front rod segment 31 and has two retained ends 431 projecting outwardly of the front rod segment 31 to be disposed upwardly of the upwardly facing retaining portion 222 of the respective sleeve tube 22. The locking pin 43 is movable along the axis (L) between a locking position, where the splits 311 are registered with selected ones of the unfolding and folding recessed regions 223, 224, and the retained ends 431 are rested on the selected ones of the unfolding and folding recessed regions 223, 224 to hold the respective side frame unit 3 in a corresponding one of the unfolding position and the folding position, and an unlocking position, where the retained ends 431 are disengaged from the upwardly facing retaining portion 222 to permit turning of the respective side frame unit 3 relative to the front frame 2. The locking pin 43 is movable smoothly along the splits 311 between the locking and unlocking positions. The connecting member 42 extends in the upright direction, and has a lower end which is securely connected to the locking pin 43, an upper end which is disposed proximate to the upper opening 342, and an elongated slot 421 which extends in the upright direction and between the upper and lower ends and which penetrates therethrough in a direction that is transverse to the extending direction of the locking pin 43. A guiding rod 63 is secured on the upright tubular wall 343 of the adaptor 34 and is inserted into the elongated slot 421 so as to further guide the movement of the connecting member 42 and the locking pin 43 in the upright direction between the locking and unlocking positions. The lock releasing member 41 is in the form of a lever which is pivotably connected to the adaptor 34 at a middle fulcrum portion 412 by means of a pivot pin 61 that extends substantially parallel to the guiding rod 63, and has a connecting portion 413 and an operating portion 411 opposite to each other in terms of the middle fulcrum portion 412 in the front-and-rear direction. The connecting portion 413 is pivoted to the upper end of the connecting member 42 by means of a connecting pin 62. The lock releasing member 41 is configured to be substantially received in the upper opening 342 and extend in the front-and-rear direction, and has the operating portion 411 projecting from the upper opening 342 to be manually operable. The operating portion 411 may be received in the upper opening 342 when pressed.

The biasing member 5 is disposed in the accommodating space 341 of the adaptor 34 to bias the locking pin 43 downwardly. In this embodiment, the biasing member 5 is a compression spring which is sleeved around the connecting member 42 and which has an end abutting against the guiding rod 63 to be secured to the adaptor 34, and an opposite end abutting against the locking pin 43.

Figure 7:
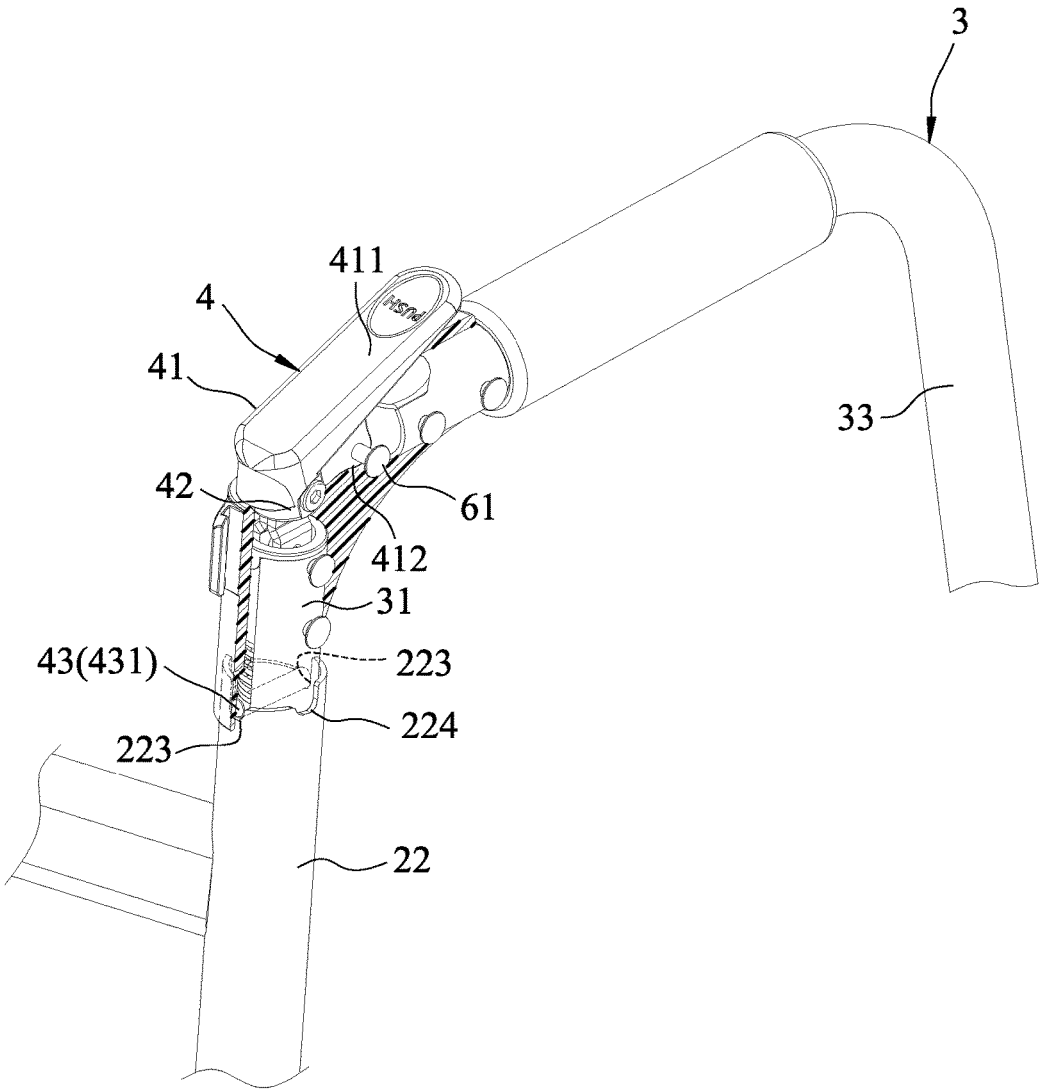
FIG. 7 is a fragmentary, partly cut-off perspective view illustrating a side frame unit of the embodiment in an unfolded position.

With reference to FIGS. 4 and 7, in the unfolded position of the side frame unit 3, the retained ends 431 of the locking pin 43 are rested on the unfolding recessed regions 223, respectively, such that the rear rod segment 33 is kept remote from the front frame 2.

Figure 8:
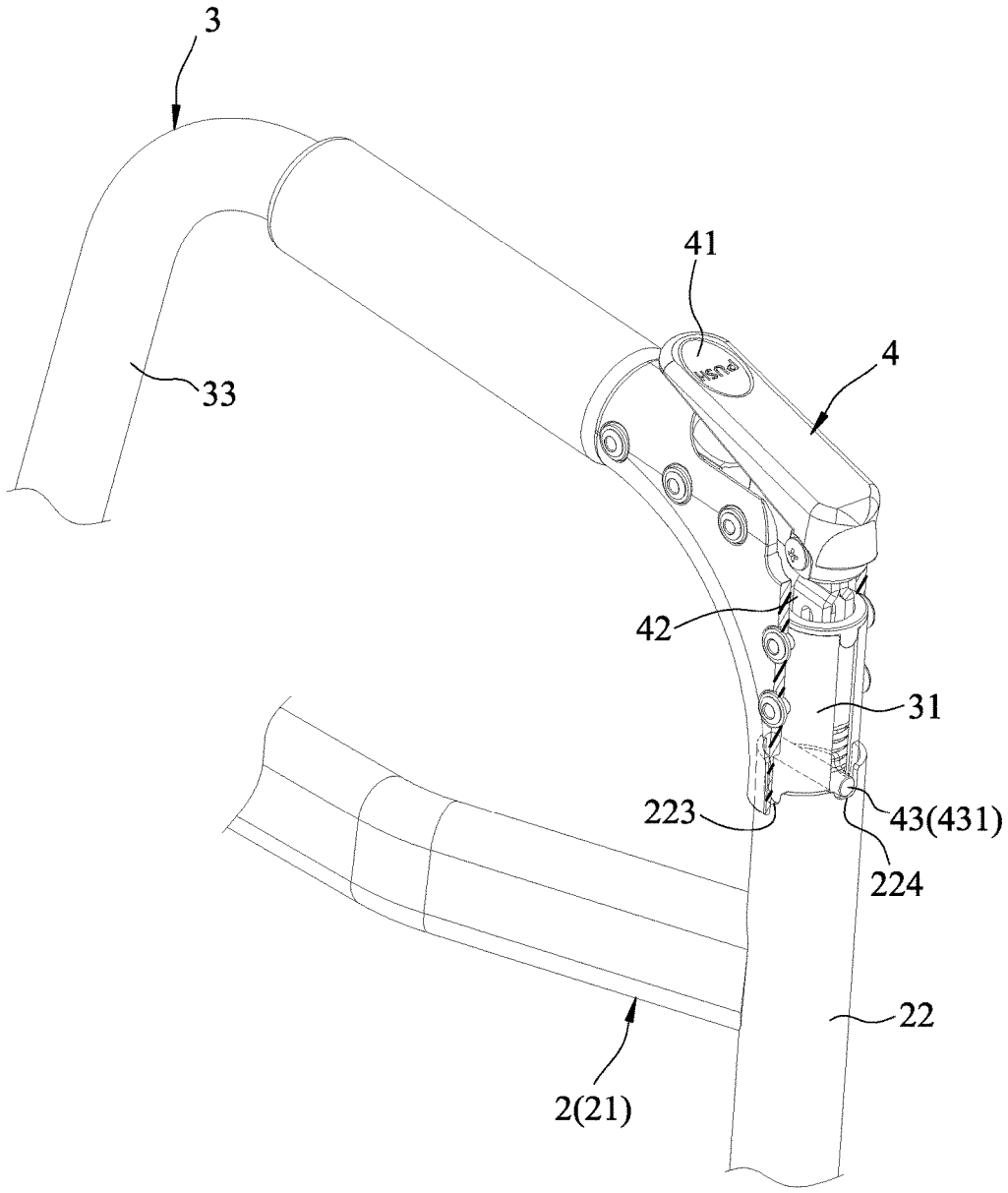
FIG. 8 is a fragmentary, partly cut-off perspective view illustrating the side frame unit of the embodiment in a folded position.

With reference to FIGS. 7 and 8, when it is desired to fold the side frame unit 3, a pressure is applied to the lock releasing member 41 to pull the connecting member 42 and the locking pin 43 upwardly so as to unlock the front rod segment 31. The respective side frame unit 3 is then turned to the folded position, where the rear rod segment 33 is close to the front frame 2. At this moment, the retained ends 431 of the locking pin 43 are registered with the folding recessed regions 224 in the upright direction and biased to rest on the folding recessed regions 224 by means of the biasing member 5 so as to lock the side frame unit 3 in the folded position for facilitating handling and storage.

As illustrated, with the folding operating unit 4 disposed in the accommodating space 341 of the adaptor 34 coaxial with the sleeve tube 22 of the front frame 2, the lock releasing member 41 is disposed in the upper opening 342 of the accommodating space 341 and in the proximity of a user's thumb when the user grips the handgrip on the side horizontal arm 32, which is convenient to be manipulated and does not interfere with the walking of the user using the foldable walker. Moreover, with the upwardly facing retaining portion 222 having the unfolding and folding recessed regions 223, 224 formed on the sleeve tube 22, the locking pin 43 can be mounted on the upwardly facing retaining portion 222 in the upright direction along the splits 311, and aligning of the lower end of the connecting member 42 with the upwardly facing retaining portion 222 can be dispensed with, which renders the assembly simple. Furthermore, with the guiding of the splits 311, and the guiding of the guiding rod 63 and the elongated slot 421, the movement of the locking pin 43 and the connecting member 42 in the upright direction between the locking and unlocking positions is smooth and stable.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A foldable walker comprising:

a front frame including two sleeve tubes which are disposed opposite to each other in a left-and-right direction, and each of which extends along an axis in an upright direction, each of said sleeve tubes having an upwardly facing retaining portion which surrounds the axis and which has an unfolding recessed region and a folding recessed region that are angularly displaced from each other about the axis;

two side frame units, each including a front rod segment which is coaxially and rotatably mounted to a respective one of said sleeve tubes, a rear rod segment which is opposite to said front rod segment so as to be turnable about the axis relative to said front frame between a folded position, where said rear rod segment is close to said front frame, and an unfolded position, where said rear rod segment is remote from said front frame to be disposed opposite to said front rod segment in a front-and-rear direction, and an adaptor, said adaptor having an upright tubular wall which is coaxially connected to said front rod segment and defines therein an accommodating space that has an upper opening; and two folding operating units, each disposed in said accommodating space and including a locking pin, a connecting member and a lock releasing member, said locking pin having a retained end which is disposed upwardly of said upwardly facing retaining portion, and extending radially and inwardly from said retained end toward the axis, said locking pin being movable along the axis between a locking position, where said retained end is engaged with a selected one of said unfolding and folding recessed regions to hold said respective side frame unit in a corresponding one of the unfolding position and the folding position, and an unlocking position, where said retained end is disengaged from said upwardly facing retaining portion to permit turning of said respective side frame unit relative to said front frame, said connecting member having a lower end which is securely connected to said locking pin and extending in the upright direction from said lower end to terminate at an upper end which is disposed proximate to said upper opening, said lock releasing member being movably mounted on said adaptor and having an operating portion which projects from said upper opening to be manually operable, and a driving portion which is connected with said upper end of said connecting member for moving said locking pin from the locking position to the unlocking position.

2. The foldable walker as claimed in claim 1, wherein said connecting member has an elongated slot which extends in the upright direction and between said upper and lower ends, each of said side frame units including a guiding rod which is secured on said upright tubular wall and extends radially and inwardly to be inserted into said elongated slot so as to guide the movement of said connecting member and said locking pin in the upright direction between the locking and unlocking positions.

3. The foldable walker as claimed in claim 2, wherein each of said folding operating units includes a biasing member which is disposed in said accommodating space of said adaptor to bias said locking pin downwardly.

4. The foldable walker as claimed in claim 3, wherein said biasing member is a compression spring which is sleeved around said connecting member and which has an end secured to a respective one of said side frame units, and an opposite end abutting against said locking pin.

5. The foldable walker as claimed in claim 4, wherein said front rod segment of each of said side frame units is coaxially inserted into said respective sleeve tube and rotatable about the axis relative to said respective sleeve tube, and has a split extending radially therethrough and elongated in the upright direction such that said locking pin extends radially and inwardly into said front rod segment through said split, and is movable along said split between the locking and unlocking positions, and such that said retained end of said locking pin is rested on the selected one of said unfolding and folding recessed regions when said split is registered with the selected one of said unfolding and folding recessed regions.

6. The foldable walker as claimed in claim 1, wherein said lock releasing member is in the form of a lever which is pivotably connected to said adaptor at a middle fulcrum portion, and which has a connecting portion that is disposed opposite to said operating portion in terms of said middle fulcrum portion in the front-and-rear direction and that is linked with said upper end of said connecting member.

7. The foldable walker as claimed in claim 6, wherein each of said folding operating units includes a biasing member which is disposed in said accommodating space of said adaptor to bias said locking pin downwardly.

8. The foldable walker as claimed in claim 7, wherein said biasing member is a compression spring which is sleeved around said connecting member and which has an end secured to a respective one of said side frame units, and an opposite end abutting against said locking pin.

9. The foldable walker as claimed in claim 8, wherein said front rod segment of each of said side frame units is coaxially inserted into said respective sleeve tube and rotatable about the axis relative to said respective sleeve tube, and has a split extending radially therethrough and elongated in the upright direction such that said locking pin extends radially and inwardly into said front rod segment through said split, and is movable along said split between the locking and unlocking positions, and such that said retained end of said locking pin is rested on the selected one of said unfolding and folding recessed regions when said split is registered with the selected one of said unfolding and folding recessed regions.

10. The foldable walker as claimed in claim 1, wherein each of said folding operating units includes a biasing member which is disposed in said accommodating space of said adaptor to bias said locking pin downwardly.

11. The foldable walker as claimed in claim 10, wherein said biasing member is a compression spring which is sleeved around said connecting member and which has an end secured to a respective one of said side frame units, and an opposite end abutting against said locking pin.

12. The foldable walker as claimed in claim 11, wherein said front rod segment of each of said side frame units is coaxially inserted into said respective sleeve tube and rotatable about the axis relative to said respective sleeve tube, and has a split extending radially therethrough and elongated in the upright direction such that said locking pin extends radially and inwardly into said front rod segment through said split, and is movable along said split between the locking and unlocking positions, and such that said retained end of said locking pin is rested on the selected one of said unfolding and folding recessed regions when said split is registered with the selected one of said unfolding and folding recessed regions.

13. The foldable walker as claimed in claim 1, wherein said front rod segment of each of said side frame units is coaxially inserted into said respective sleeve tube and rotatable about the axis relative to said respective sleeve tube, and has a split extending radially therethrough and elongated in the upright direction such that said locking pin extends radially and inwardly into said front rod segment through said split, and is movable along said split between the locking and unlocking positions, and such that said retained end of said locking pin is rested on the selected one of said unfolding and folding recessed regions when said split is registered with the selected one of said unfolding and folding recessed regions.

14. The foldable walker as claimed in claim 1, wherein said adaptor has a horizontal tubular wall which extends rearwardly from said upright tubular wall, said upper opening extending rearwardly through said horizontal tubular wall such that said lock releasing member is disposed in the front-and-rear direction to have said operating portion received in said upper opening when operated.

* * * * *